US006666616B2

(12) United States Patent
Yodock, III et al.

(10) Patent No.: US 6,666,616 B2
(45) Date of Patent: Dec. 23, 2003

(54) BARRIER DEVICE WITH EXTERNAL REINFORCEMENT STRUCTURE

(76) Inventors: Leo J. Yodock, III, 2832 Cleveland St., Hollywood, FL (US) 33020; Leo J. Yodock, Jr., 623 NE. 5th Ter., Fort Lauderdale, FL (US) 33304; Guy C. Yodock, 623 NE. 5th Ter., Fort Lauderdale, FL (US) 33304

( * ) Notice: Subject to any disclaimer, the term of this patent is extended or adjusted under 35 U.S.C. 154(b) by 91 days.

(21) Appl. No.: 10/033,974

(22) Filed: Dec. 19, 2001

(65) Prior Publication Data

US 2003/0113161 A1 Jun. 19, 2003

(51) Int. Cl.[7] ..... F01F 13/00
(52) U.S. Cl. ..... 404/6; 256/13.1
(58) Field of Search ..... 404/6, 10; 256/13.1; 188/377

(56) References Cited

U.S. PATENT DOCUMENTS

| | | | | | |
|---|---|---|---|---|---|
| 4,059,362 | A | | 11/1977 | Smith | 404/6 |
| 4,391,077 | A | | 7/1983 | Giess | 52/747 |
| 4,681,302 | A | | 7/1987 | Thompson | 256/13.1 |
| 4,773,629 | A | | 9/1988 | Yodock | 256/13.1 |
| 4,946,138 | A | * | 8/1990 | Gaillard et al. | 256/13.1 |
| 4,946,306 | A | | 8/1990 | Yodock | 404/6 |
| 5,030,029 | A | * | 7/1991 | Johnsen | 404/6 |
| 5,123,773 | A | | 6/1992 | Yodock | 404/6 |
| 5,387,049 | A | | 2/1995 | Duckett | 404/6 |
| 5,425,594 | A | * | 6/1995 | Krage et al. | 404/6 |
| 5,498,101 | A | | 3/1996 | Braverman | 404/6 |
| 5,531,540 | A | | 7/1996 | Wasserstrom et al. | 404/6 |
| 5,605,413 | A | | 2/1997 | Brown | 404/6 |
| 5,882,140 | A | | 3/1999 | Yodock, Jr. et al. | 404/6 |
| 6,164,865 | A | * | 12/2000 | McCallum | 404/6 |
| 6,179,516 | B1 | * | 1/2001 | Ivey et al. | 404/6 |
| 6,428,237 | B1 | * | 8/2002 | Duckett | 404/6 |

* cited by examiner

*Primary Examiner*—Gary S. Hartmann
(74) *Attorney, Agent, or Firm*—Holland & Knight LLP

(57) ABSTRACT

A barrier device comprises a top wall, a bottom wall, opposed end walls and opposed side walls interconnected to form a hollow interior in which a pair of spaced openings are formed which extend between the side walls. An external reinforcement structure is provided to enhance the structural integrity of the barrier device, including first and second beams each located along one of the side walls which are connected to one another by a mounting device extending through the openings in the hollow interior, or, alternatively, are mounted within a seat formed in each side wall between the opposed ends of the barrier device. The beams of one barrier device, in turn, are connected end-to-end with the beams of adjacent barrier devices to form an essentially continuous wall of barriers which resist disengagement from one another and exhibit improved resistance to being broken apart upon impact by a vehicle.

30 Claims, 9 Drawing Sheets

10
22
12
136
20
14

10
22
132
130
132
130
14
132
24
134
130
12
132
132
20

122
112
120
122
116
118
114
110

122
112
120
118
110

BARRIER DEVICE WITH EXTERNAL REINFORCEMENT STRUCTURE

FIELD OF THE INVENTION

This invention relates to barrier devices for vehicular and vessel traffic control, soil erosion containment, impact attenuation and the like which can be interconnected with one another to define a continuous barrier wall structure and/or connected in various combinations to form energy-absorbing cells, and, more particularly, to barrier devices formed of a light weight plastic having openings extending through the hollow interior of the barrier which receive and mount external reinforcement structure in the form of a pair of beams each extending along the length of one of the side walls and are connected to one another through the openings.

BACKGROUND OF THE INVENTION

A variety of different devices have been developed for absorbing the kinetic energy of impact of colliding automobiles, and for the containment of forces exerted by soil or water. Highway barrier devices, for example, are intended to provide a continuous wall or barrier along the center line of a highway when laid end-to-end to absorb grazing blows from moving vehicles. One commonly used highway barrier is formed of pre-cast reinforced concrete, and is known as the "New Jersey" style barrier. Highway barriers of this type have a relatively wide base including side walls which extend vertically upwardly from the pavement a short distance, then angle inwardly and upwardly to a vertically extending top portion connected to the top wall of the barrier. This design is intended to contact and redirect the wheels of a vehicle in a direction toward the lane of traffic in which the vehicle was originally traveling, instead of the lane of opposing traffic. See U.S. Pat. No. 4,059,362.

One problem with highway barriers of the type described above is the high weight of reinforced concrete. A barrier having a typical length of twelve feet weighs about 2,800–3,200 pounds and requires special equipment to load, unload and handle on site. It has been estimated that for some road repairs, up to 40 percent of the total cost is expended on acquiring, delivering and handling concrete barriers. Additionally, concrete barriers have little or no ability to absorb shock upon impact, and have a high friction factor. This increases the damage to vehicles which collide with such barriers, and can lead to serious injuries to passengers of the vehicle.

In an effort to reduce weight, facilitate handling and shipment, and provide improved absorption of impact forces, highway barriers have been designed which are formed of a hollow plastic container filled with water, sand or other ballast material such as disclosed in U.S. Pat. Nos. 4,681,302; 4,773,629; 4,846,306, 5,123,773 and 5,882,140. For example, the '302 patent discloses a barrier comprising a container having a top wall, a bottom wall, opposed side walls and opposed end walls interconnected to form a hollow interior which is filled with water, and having fittings for coupling one barrier to another to form a continuous wall. The container structure is formed of a resilient material which is deformable upon impact and capable of resuming its original shape after being struck. Longitudinally extending, spaced traction spoiler channels are said to reduce the area of potential impact and thus the tendency of the vehicle to climb the walls of the barrier and vault over it into the opposing lane of traffic.

The '629, '306, '773 and '140 patents noted above were invented by the present inventor and represent further advances in deformable highway barrier designs. The first two patents disclose barriers which comprise a longitudinally extending container made of semi-rigid plastic which is self-supporting, and has a predetermined shape which is maintained when filled with water, sand or other ballast material. Such devices are connected end-to-end by a key insertable within grooves formed in the end walls of adjacent barriers. Interconnected fill openings are provided which permit adjacent barriers to be filled with water or the like when laid end-to-end.

The '773 and '140 patents disclose further improvements in barrier devices including side walls formed with higher curb reveals, a horizontally extending step and vertical indentations in order to assist in maintaining the structural integrity of the container, and to create internal baffles for dampening movement of water or other fluid within the container interior. Interlocking male and female coupling elements are formed on opposite end walls of the barrier to facilitate end-to-end connection thereof. Additionally, such barriers are formed with channels or openings to permit the insertion of the tines of a fork lift truck therein for easy handling of the barriers.

Despite the improvements in highway barrier designs noted above, some deficiencies nevertheless remain. One concern has been with the ability of a wall of barriers, e.g. individual barriers connected end-to-end, to withstand a direct impact by a speeding vehicle. It has been found that plastic barriers tend to separate from one another at their connections, and in some instances break apart in response to the vehicle impact. Although concrete barriers of the type described above also can break apart during a crash, they are more resistant to that than plastic barriers and there is a need for plastic barriers to demonstrate impact resistance capabilities which more closely approximates those of concrete barriers.

SUMMARY OF THE INVENTION

It is therefore among the objectives of this invention to provide a barrier device for use as a highway barrier or other energy absorbing structure which is easily transported, handled and assembled, but which is also resistant to being broken apart in response to an impact with a vehicle.

These objectives are accomplished in a barrier device comprising a top wall, a bottom wall, opposed end walls, and, opposed side walls interconnected to form a hollow interior in which a pair of spaced openings are formed which extend between the side walls. An external reinforcement structure is provided to enhance the structural integrity of the barrier device, including first and second beams each extending along one of the side walls which are connected to one another by a mounting device extending through the openings, or, alternatively, are mounted within a seat formed in each side wall between the opposed ends of the barrier device. The beams of one barrier device, in turn, are connected end-to-end with the beams of an adjacent barrier device to form an essentially continuous, interconnected wall of barriers which resist disengagement from one another and exhibit improved resistance to being broken apart upon impact by a vehicle.

The openings extending through the hollow interior are fork lift holes which are sized to receive the tines of a fork lift to permit movement of the barrier device during loading, unloading and assembly. In one presently preferred embodiment of this invention, the external reinforcement structure comprises a first box beam and a second box beam, each generally square in cross section and formed of metal, rubber, composite material or the like. Each box beam is hollow, at least at its opposite ends, in order to receive and mount one end of a connector bar whose other end is mounted within the box beam of an adjacent barrier device. The cross section of the connector bar is sufficiently smaller than that of the box beams to permit at least limited pivotal movement of the connector bar within the beams, and hence, pivotal movement between the adjacent barrier devices.

The two box beams are connected to one another by a pair of brackets each including a plate mounted at each edge to one of a pair of upstanding legs. One bracket is inserted within each of the fork lift holes and has a length dimension such that its ends protrude from the side walls. Each box beam rests atop a protruding end of both brackets and is bolted in place to connect it to the bracket and, in turn, to the box beam on the other side wall. Because the brackets have upstanding legs, clearance is provided within each fork lift hole to receive the tines of a fork lift even with the brackets and box beams in place.

In an alternative embodiment, a pair of box beams similar to those noted above are employed except they are connected to one another by telescoping members associated with each beam. One of the box beams mounts a pair of sleeves extending perpendicular thereto, and the other box beam mounts a pair of arms which align with the sleeves and are inserted therein when the beams are positioned along the side walls. The box beams associated with one barrier device are connected to those of an adjacent barrier by means of telescoping ends of the beams. One end of each beam has a reduced cross sectional area which telescopes into the opposite end of an adjacent beam having a larger cross section. The beams of one barrier device may be connected to the beams of an adjacent barrier device by a friction fit, or with fasteners such as bolts.

Additional embodiments of this invention employ "beams" in the form of the box beams noted above, or solid slats, which are mounted within longitudinally extending seats formed in the side walls of each barrier device between the end walls. These seats receive and frictionally maintain the beams in place, and connecting structure is provided to mount the ends of each beam of one barrier device to those of an adjacent barrier device.

In another aspect of this invention, a rotational molding process is employed to combine crosslinkable high density polyethylene material with polyethylene foaming pellets to form the barrier device noted above with walls having an interior surface covered with a layer of foam. The plastic, polyethylene walls have a thickness on the order of about 0.25 inches, and the foam layer is in the range of about 0.5 to 6 inches in thickness depending upon the amount of foaming pellets used. Fill holes are formed in the top wall of the barrier so that water, sand or other ballast material can be introduced into the hollow interior and into contact with the foam layer. In an alternative embodiment, substantially the entire hollow interior of the barrier is filled with foam material. Preferably, a liquid material is introduced into the hollow interior through one or more of the fill holes, which then cures to form a foam which expands to fill all or a part of the entire volume of the barrier interior.

It has been found that barrier devices filled with foam can be interconnected end-to-end to form a barrier wall which readily floats in water, and the external reinforcement structure adds overall strength, rigidity and resistance to separation and breaking apart of individual barriers within such barrier wall. These floating barrier walls can be used in various naval applications to encircle ships or other assets, or to segregate areas within a port or dock area, as desired.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE PREFERRED EMBODIMENT

Figure 1:
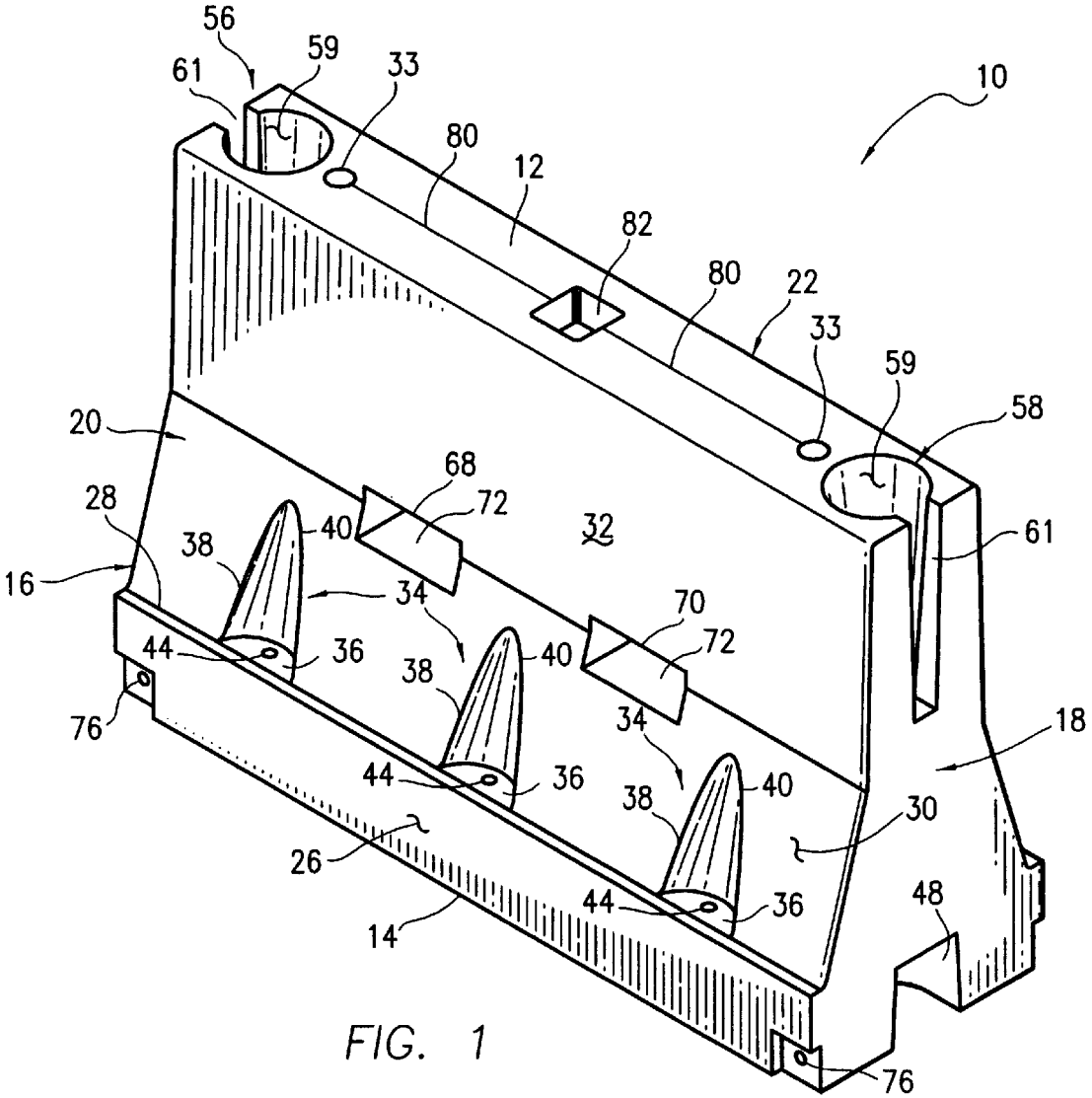
FIG. 1 is a perspective view of the barrier of this invention.

Referring initially to FIGS. 1–4, the barrier device 10 of this invention comprises a top wall 12, a bottom wall 14, opposed end walls 16, 18, and, opposed side walls 20, 22 which are interconnected to collectively define a hollow interior 24. In the presently preferred embodiment, each of the walls 12–22 are formed of a semi-rigid plastic material chosen from the group consisting of low density polyethylene, high density polyethylene, acrylonitrile or butadiene styrene, high impact styrene, polycarbonates and the like. These plastic materials are all inherently tough and exhibit good energy absorption characteristics. They will also deform and elongate, but will not fail in a brittle manner at energy inputs which cause other materials to undergo brittle failure. The surfaces of these types of plastic materials are inherently smoother than materials from which other barriers are typically constructed, therefore creating less friction and reducing the likelihood of serious abrasion injuries to vehicles and/or passengers who may come into contact therewith. Additionally, materials of this type are unaffected by weather and have excellent basic resistance to weathering, leaching and biodegradation. Additives such as ultraviolet inhibitors can be added thereto, making such materials further resistant to the effects of weather. They also retain their mechanical and chemical properties at low ambient temperatures.

When using the barrier device 10 of this invention as a highway barrier, the hollow interior 24 is preferably filled with a "ballast" material such as water or other liquid, or a flowable solid material such as sand, concrete and the like. For this purpose, the walls 12–22 of barrier device 10 have a thickness in the range of about one-eighth inch to one inch so as to perform satisfactorily in service. The barrier device 10 is preferably in the range of about six to eight feet in length, and, at the wall thickness noted above, has a weight when empty of about 80 to 140 lbs. When filled with a liquid such as water, the overall weight of the barrier is in the range of about 1400 to 2200 lbs. Flowable solid material such as sand and the like increase the weight of barrier 10 further.

For ease of understanding and discussion of the principal aspects of this invention, the various structural elements of the barrier device 10 are described below in relation to their collective performance of a particular function of the barrier 10. These functions include the ability of the barrier 10 to better redirect and control the upper movement of a vehicle upon impact therewith, the ability to resist lateral separation of adjacent barriers 10 when they are joined end-to-end to form an essentially continuous wall, the ability to resist break up or disintegration of individual barriers in response to impact from a vehicle and the ability to float in water.

Control of Vehicle Movement

The control of vehicle movement upon impact with the barrier device 10 of this invention is achieved primarily by the material with which the barrier 10 is constructed, and the configuration of its side walls 20 and 22. Because both side walls 20, 22 are identical in configuration, only side wall 20 is described in detail herein, it being understood that the side wall 22 is formed with the identical structure and functions in the same manner.

The side wall 20 includes a substantially vertically extending curb reveal 26 which extends from the bottom wall 14 to a horizontally extending ledge or step 28 best shown in FIG. 1. Preferably, the curb reveal 26 has a vertical height of nine inches, measured from the bottom wall 14 upwardly, which is at least two inches greater than the curb reveals of other highway barrier devices, such as disclosed, for example, in my prior U.S. Pat. No. 5,123,773. The horizontal extent of the step 28 is preferably on the order of about 1½ inches measured in the direction from the outer edge of curb reveal 26 toward the hollow interior 24 of barrier device 10.

Extending upwardly at an acute angle from the step 28 is an intermediate section 30 which terminates at a vertically extending upper section 32. The upper section 32, in turn, extends from the intermediate section 30 to the top wall 12 of barrier 10 which is formed with a pair of fill holes 33 preferably having a diameter in the range of about 3–4 inches. In the presently preferred embodiment, a number of stabilizers 34 are integrally formed in the intermediate section 30, at regularly spaced intervals between the end walls 16, 18. Each stabilizer 34 includes a base 36 and opposed sides 38 and 40. As best seen in FIG. 1, the base 36 of each stabilizer 34 is coplanar with the step 28 and is supported by an internally located support 42 shown in phantom lines in FIG. 3. The sides 38, 40 of each stabilizer 34 taper inwardly, toward one another, from the base 36 to a point substantially coincident with the uppermost edge of intermediate section 30 where the upper section 32 of side wall 20 begins. In the presently preferred embodiment, a throughbore 44 extends from the base 36 of one or more of the stabilizers 34, through the internal support 42 and out the bottom wall 14 of barrier 10. One or more of these throughbores 44 receive an anchoring device such as a stake 46, shown in phantom in FIG. 3, which can be driven into the ground or other surface upon which the barrier device 10 rests to secure it in an essentially permanent position thereon.

Enhanced control and redirection of the path of a vehicle impacting the barrier device 10 of this invention is achieved with the above-described structure as follows. The increased height of the curb reveal 26 of side wall 20, e.g., nine inches compared to seven inches or less for conventional barriers, is effective to engage and redirect the tires of a vehicle toward the lane in which the vehicle was traveling instead of in a direction toward the barrier 10 or the opposing lane of traffic. The curb reveal 26 is strengthened and reinforced by the presence of the horizontally extending ledge or step 28 and the stabilizers 34.

In the event the vehicle tires nevertheless extend above the curb reveal 26 upon impact, the intermediate and upper sections 30 and 32 are designed to resist further upward movement of the vehicle therealong. While the stabilizers 34 in intermediate section 30 function to add rigidity and stability to the overall barrier 10, the intermediate section 30 is nevertheless designed to at least partially collapse inwardly or buckle in response to the application of an impact force thereto. The extent of inward motion of buckling is controlled, at least to some extent, by the diameter of the fill holes 33 in the top wall 12. When the barrier interior 24 is filled with water, for example, the impact of a vehicle with a barrier side wall 20 or 22 causes such water to displace from the area of contact. Some of the water is forcefully discharged from the interior 24 through the fill holes 33, and the amount of such energy displacement is dependent on the diameter of the holes 33. The greater the diameter, the greater the amount of water displaced, and, hence, the more the barrier side wall 20 or 22 is permitted to buckle. It has been found that a fill hole 33 diameter of about 3–4 inches, noted above, is optimum wherein sufficient buckling of the side walls 20, 22 is permitted for the purposes described below without permanent damage to the barrier 10 upon impact with a vehicle. In the presently preferred embodiment, when the intermediate section 30 buckles inwardly, a pivot point is created about which the upper section 32 can move in a generally downward direction. Consequently, the tire and/or bumper of the vehicle is impacted by the upper section 32 of barrier device 10 and urged downwardly, back toward the pavement or ground along which the vehicle was traveling. This substantially prevents the vehicle from vaulting over the top of the barrier 10 and entering the opposing lane of traffic. Despite such movement of the intermediate and upper sections 30, 32 in response to impact, the material from which barrier device 10 is constructed allows such sections 30, 32 to return to their original shape after deformation.

Figure 2:
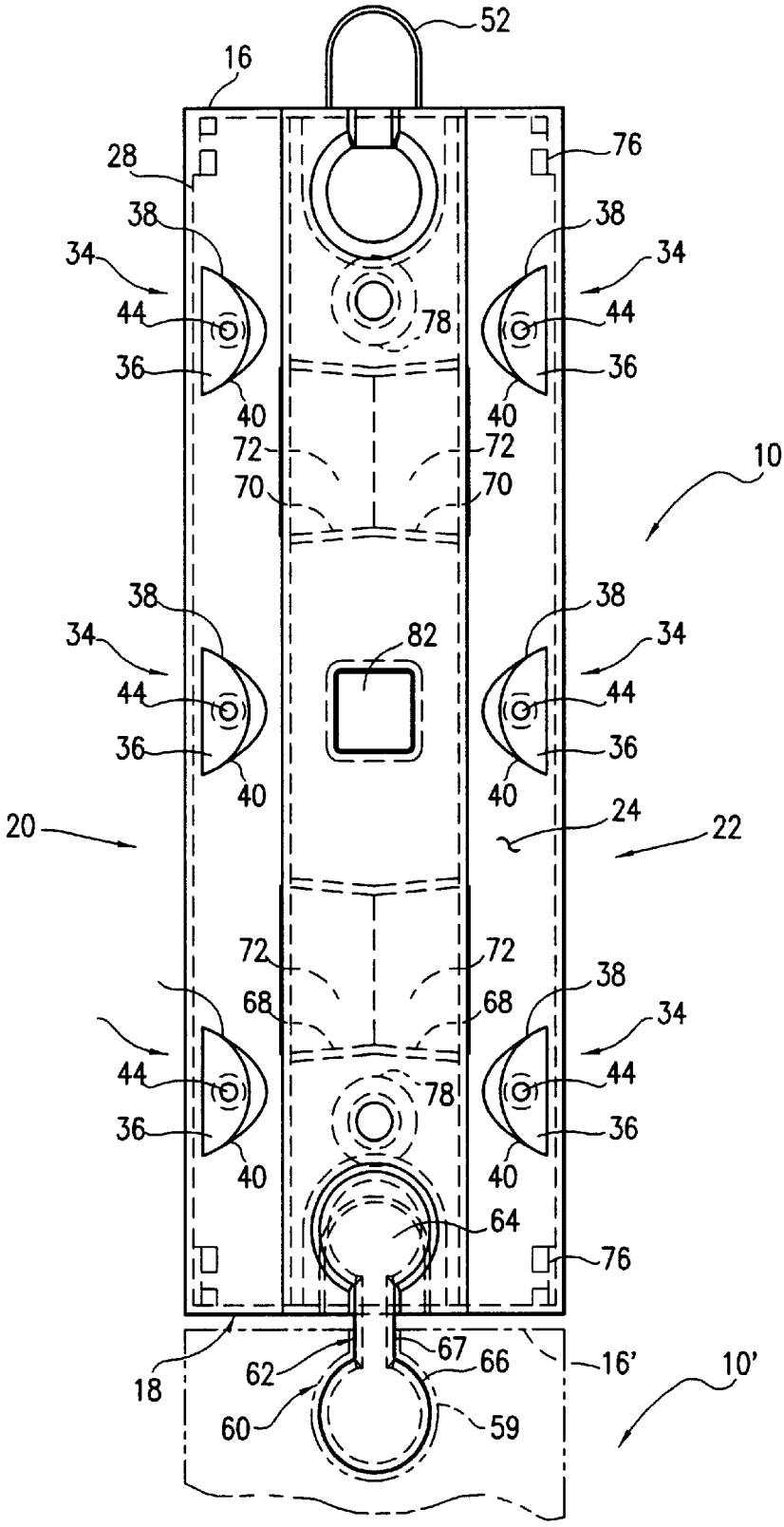
FIG. 2 is a plan view of the barrier depicted in FIG. 1, with a second barrier shown in phantom at one end.
Figure 3:
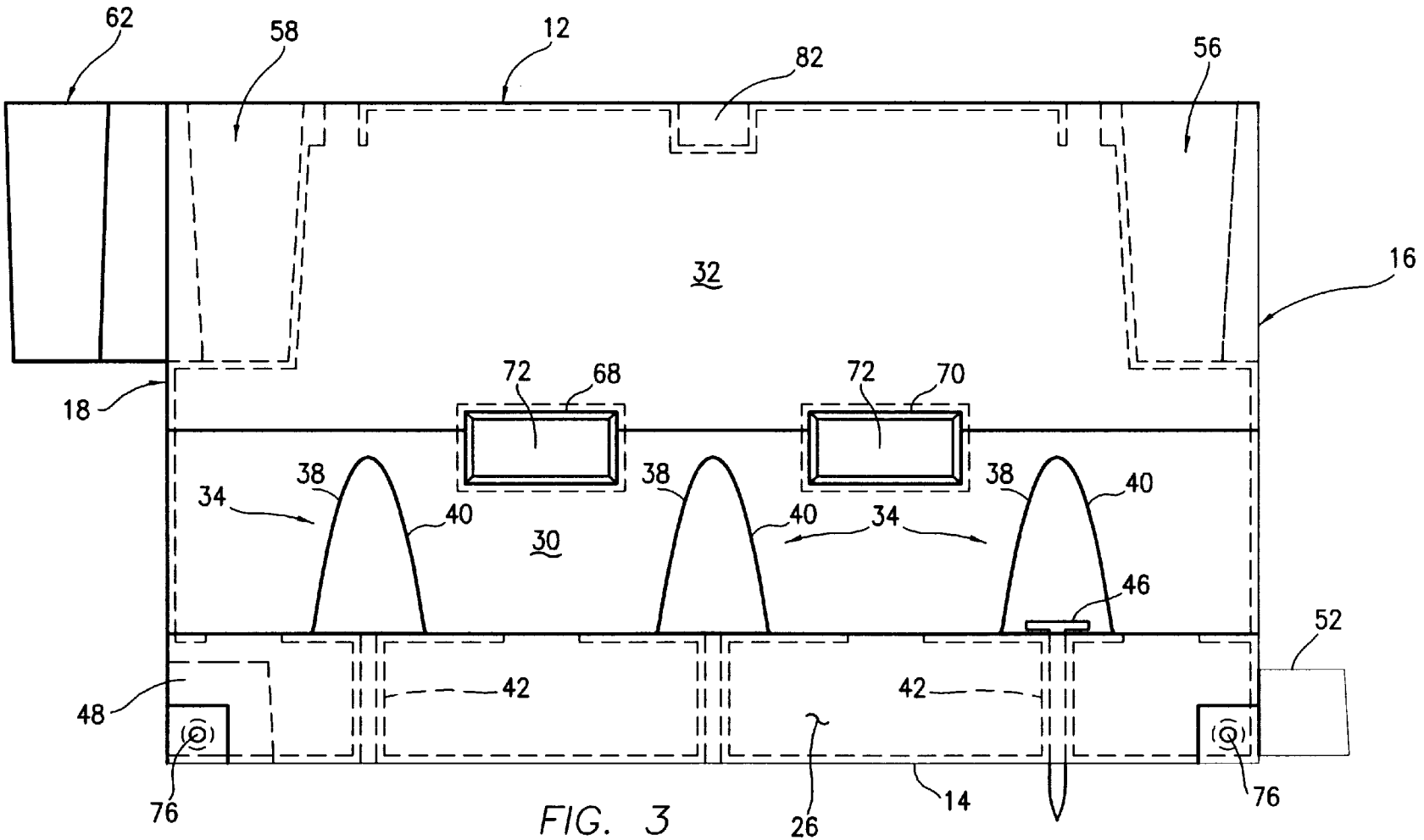
FIG. 3 is a side view of the barrier of FIG. 1.

In the presently preferred embodiment, a drain hole 76 is formed along each of the end walls 18 and 20 thereof near the bottom wall 14 to allow passage of water and the like from one side of the barrier device 10 to the other. Water or other flowable material is introduced into the hollow interior 24 of the barrier device 10 via the fill holes 33 formed in top wall 12. These fill holes 33 can also receive the post of a sign or the like (not shown) extendable into the barrier interior 24. As shown in FIG. 2, a post boot 78 is formed at the bottom wall 14 of barrier 10, in alignment with each fill hole 33, to receive and support the post of a sign inserted through the fill hole 33. Preferably, the top wall 12 is formed with an elongated channel 80 leading to each fill hole 33 to allow for the flow of rainwater into the hollow interior 24. The top wall 12 is also formed with an internally extending seat 82 which is adapted to mount an internal light fixture (not shown) for illuminating the barrier device 10 from the inside. The details of such lighting construction form no part of this invention and are thus not discussed herein.

Resistance to Barrier Disengagement and Break Up

Figure 4:
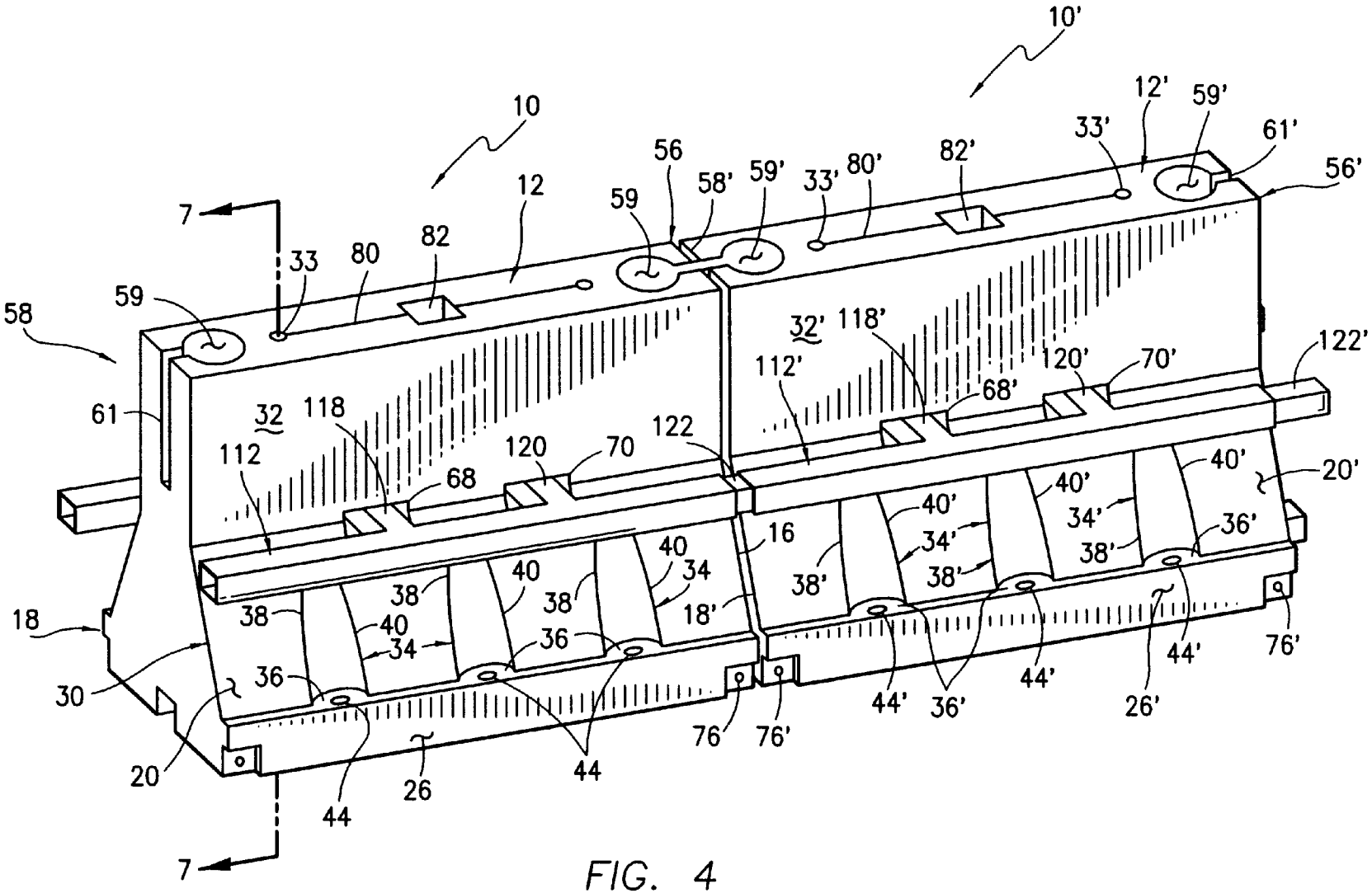
FIG. 4 is a perspective view of two barriers connected end-to-end with one embodiment of the external reinforcement structure of this invention.
Figure 9:
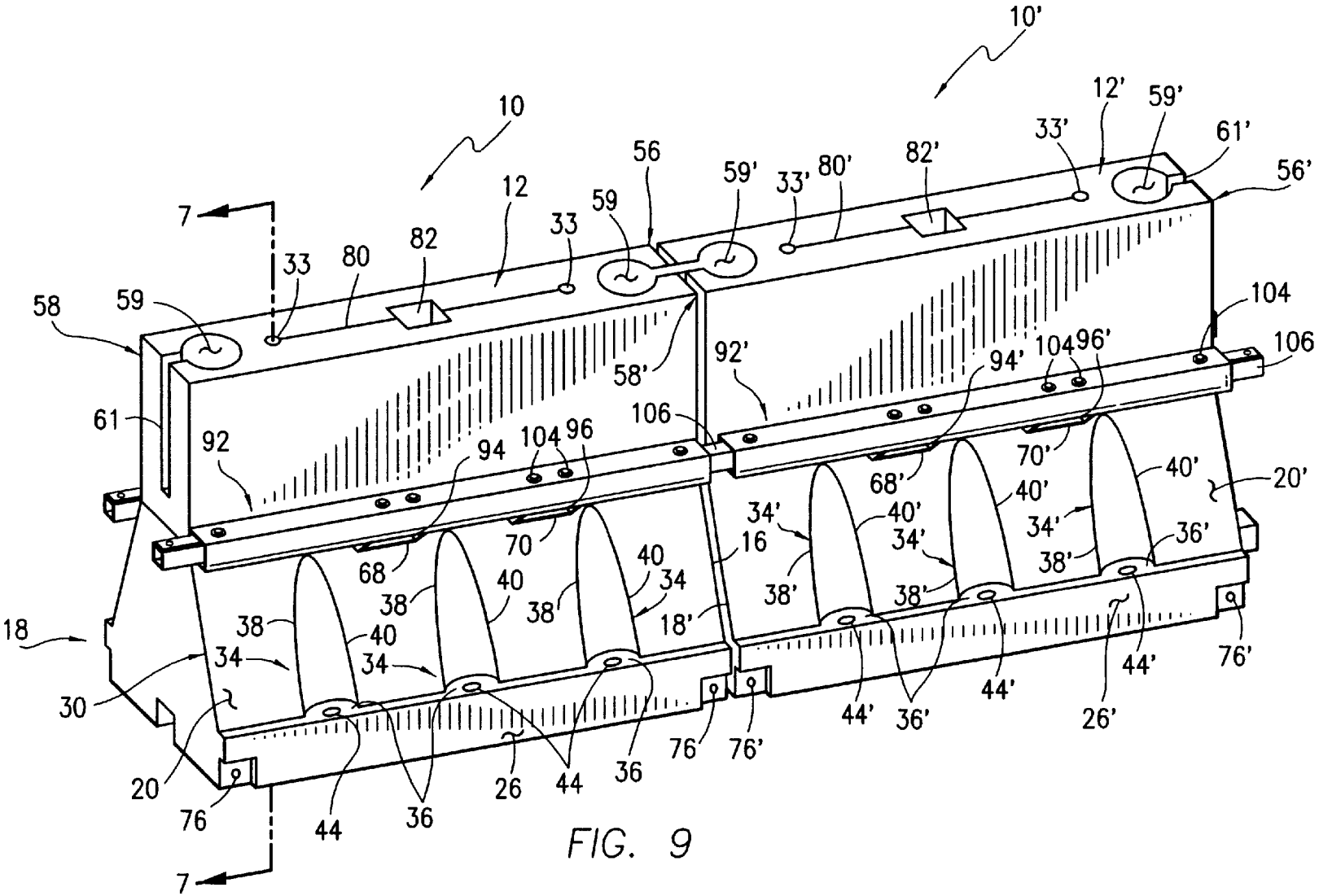
FIG. 9 is a view similar to FIG. 4, except depicting an alternative embodiment of the external reinforcement structure of this invention.

Another general aspect of the construction of the barrier device 10 of this invention involves a number of elements designed to resist disengagement of adjacent barrier devices 10 and 10' when they are arranged end-to-end to form an essentially continuous wall, and to resist the break up or disintegration of individual barrier devices 10 and 10' in response to impact by a vehicle. Two barrier devices 10 and 10' are depicted in FIGS. 4 and 9, which are identical in structure and function. The same reference numbers are therefore used to identify like structure, with the addition of a "'" to the numbers associated with barrier 10' on the right-hand side of FIGS. 4 and 9.

Each end wall 16 of barriers 10 is formed with an internally extending recess 48 near the bottom wall 14, which receives an outwardly protruding extension 52 formed on the end wall 18 of an adjacent barrier 10. The upper portion of end wall 16 is formed with a slot 56, and the upper portion of end wall 18 is formed with a slot 58. Each slot 56, 58 has an inner, generally cylindrical-shaped portion 59 and a narrower, substantially rectangular-shaped portion 61 at their respective end walls 16, 18. The slots 56, 58 extend from the top wall 12 downwardly to a point near the juncture of the upper section 32 and intermediate section 30.

When two barrier devices 10 and 10' are oriented end-to-end, with the end wall 16 of one barrier 10 abutting the end wall 18' of an adjacent barrier 10', the slots 56, 58 collectively form a barbell-shaped locking channel 60 shown in FIG. 4 and also depicted in phantom at the bottom of FIG. 2. This locking channel 60 receives a coupler 62 having cylindrical ends 64, 66 and a rectangular center section 67, which is removably insertable therein and extends substantially along the entire length of the locking channel 60. The cylindrical ends 64, 66 of coupler 62 pivot within the correspondingly shaped cylindrical portions 59, 59' of slots 56, 58', so that one barrier device 10 can be pivoted with respect to an adjacent barrier 10' to assist with alignment thereof, and to allow the barriers 10, 10' when placed end-to-end to follow curves along a particular highway or other location where they are placed.

Additionally, a pair of hollow channels 68 and 70 are located within the hollow interior 24 of barrier device 10 and extend between the side walls 20, 22. A portion of both channels 68, 70 is located in the intermediate section 30 of each side wall 20, 22, and extends partially into the upper sections 32 thereof. The two channels 68, 70 are positioned in the spaces between the three stabilizers 34 formed in the side walls 20, 22, and provide added internal support to the barrier 10 so that it retains its shape when filled with a ballast material. Each of the channels 68 and 70 define a pass-through hole or opening 72 adapted to receive the tines of a forklift truck to permit handling of the barriers 10.

In the presently preferred embodiment, a drain hole 76 is formed along each of the end walls 18 and 20 thereof near the bottom wall 14 to allow passage of water and the like from one side of the barrier device 10 to the other. Water or other flowable material is introduced into the hollow interior 24 of the barrier device 10 via the fill holes 33 formed in top wall 12. These fill holes 33 can also receive the post of a sign or the like (not shown) extendable into the barrier interior 24. As shown in FIG. 2, a post boot 78 is formed at the bottom wall 14 of barrier 10, in alignment with each fill hole 33, to receive and support the post of a sign inserted through the fill hole 33. Preferably, the top wall 12 is formed with an elongated channel 80 leading to each fill hole 33 to allow for the flow of rainwater into the hollow interior 24. The top wall 12 is also formed with an internally extending seat 82 which is adapted to mount an internal light fixture (not shown) for illuminating the barrier device 10 from the inside. The details of such lighting construction form no part of this invention and are thus not discussed herein.

Figures 10, 11, 12, 13:
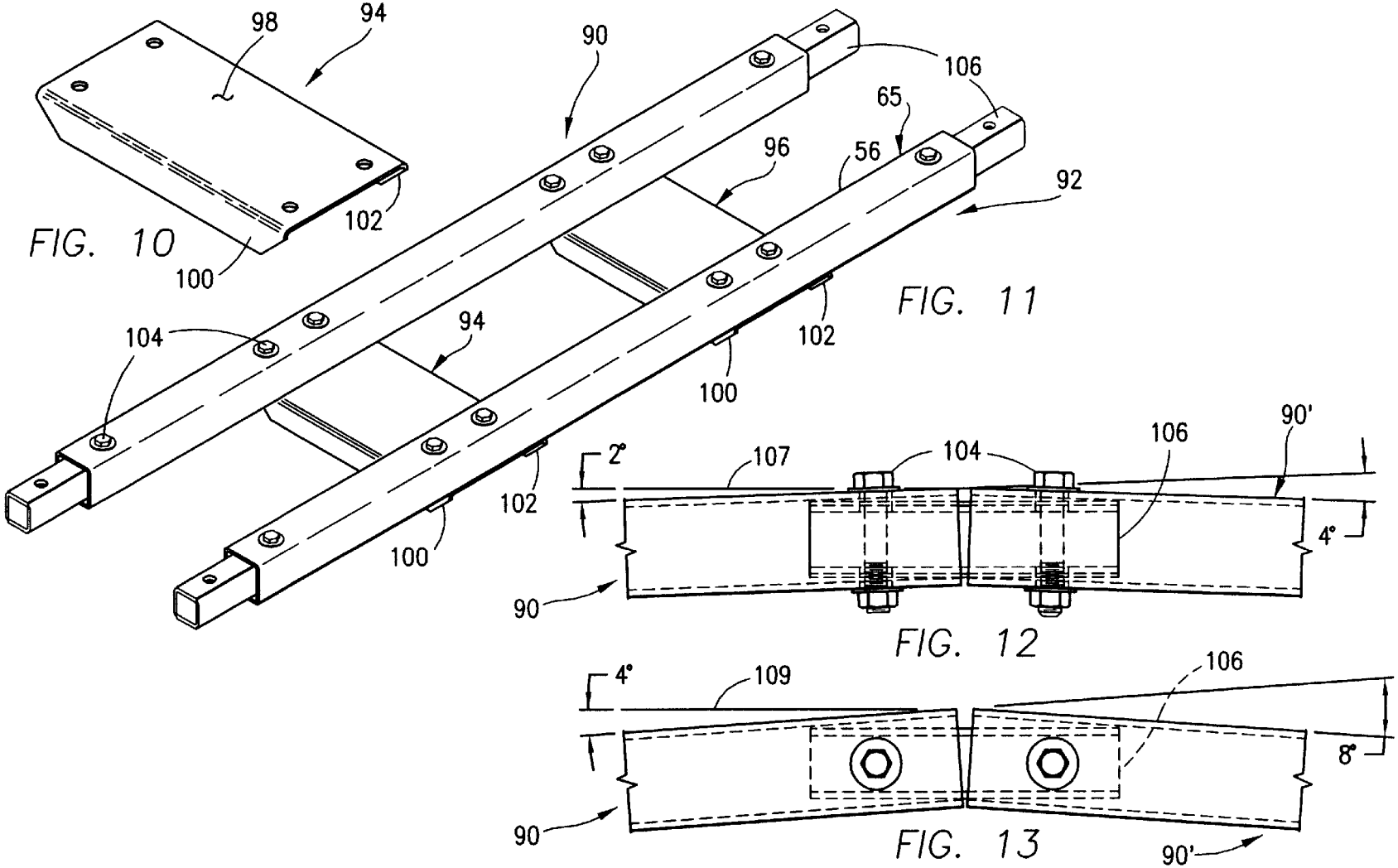
FIG. 10 is a perspective view of the mounting bracket employed in the embodiment of FIG. 9.
FIG. 11 is a perspective view of the assembled external reinforcement structure of the barrier device in FIG. 9.
FIG. 12 is a side elevational view of a portion of FIG. 11.
FIG. 13 is a plan view of a portion of FIG. 11.

With reference to FIGS. 9–13, one embodiment of the external reinforcement structure of this invention is shown. Preferably, the reinforcing structure comprises a first beam 90 and a second beam 92 which are connected to one another by a pair of mounting brackets 94 and 96. As shown, the beams 90, 92 are preferably hollow box beams having a generally square cross section which can be formed of metal, rubber, composite material or the like. The mounting brackets 94 and 96 each include a plate 98 whose opposite side edges are mounted to or integrally formed with vertically upstanding legs 100 and 102. The mounting bracket 94 is inserted within the opening 72 formed by channel 68, and the mounting bracket 96 is inserted within the opening 72 formed by channel 70 such that opposite ends of each mounting bracket 94, 96 protrude from one of the side walls 20 and 22. As best seen in FIGS. 9 and 11, with the mounting brackets 94, 96 in this position, the box beams 90 and 92 are connected to respective ends of the brackets 94, 96 such as by bolts 104. Because the mounting brackets 94, 96 include the upstanding legs 100 and 102, the channels 72 are not completely obstructed upon assembly of the beams 90, 92 and the tines of a fork lift can still be inserted within the openings 72 with the mounting brackets 94, 96 and beams 90, 92 assembled to the barrier 10 or 10'.

In order to interconnect the beams 90, 92 of one barrier device 10 to those of an adjacent barrier device 10', a connector bar 106 is inserted within one open end of each beam 90, 92 and retained in place by bolts 104. The connector bars 106 have a cross sectional area which is sufficiently less than that of the ends of beams 90, 92 to permit pivotal motion of the beams 90, 92 of barrier 10 relative to the beams 90', 92' of barrier 10' as depicted in FIGS. 12 and 13. The view in FIG. 12 is representative of vertically upward and downward relative movement of two beams 90 and 90' from barrier devices 10 and 10', respectively, which in the orientation as shown, amounts to about 2° movement of each relative to a horizontal plane 107 and 4° of movement with respect to one another. FIG. 13 illustrates relative side-to-side horizontal movement of the beams 90 and 90' in an amount of about 4° measured from the horizontal plane 109 and about 8° with respect to one another. This feature enables one barrier device 10 to pivot relative to an adjacent barrier device 10' to accommodate at least gradual curves and height differentials when forming a barrier wall, and to facilitate assembly of the barriers 10, 10'.

Figures 5, 6, 7, 8:
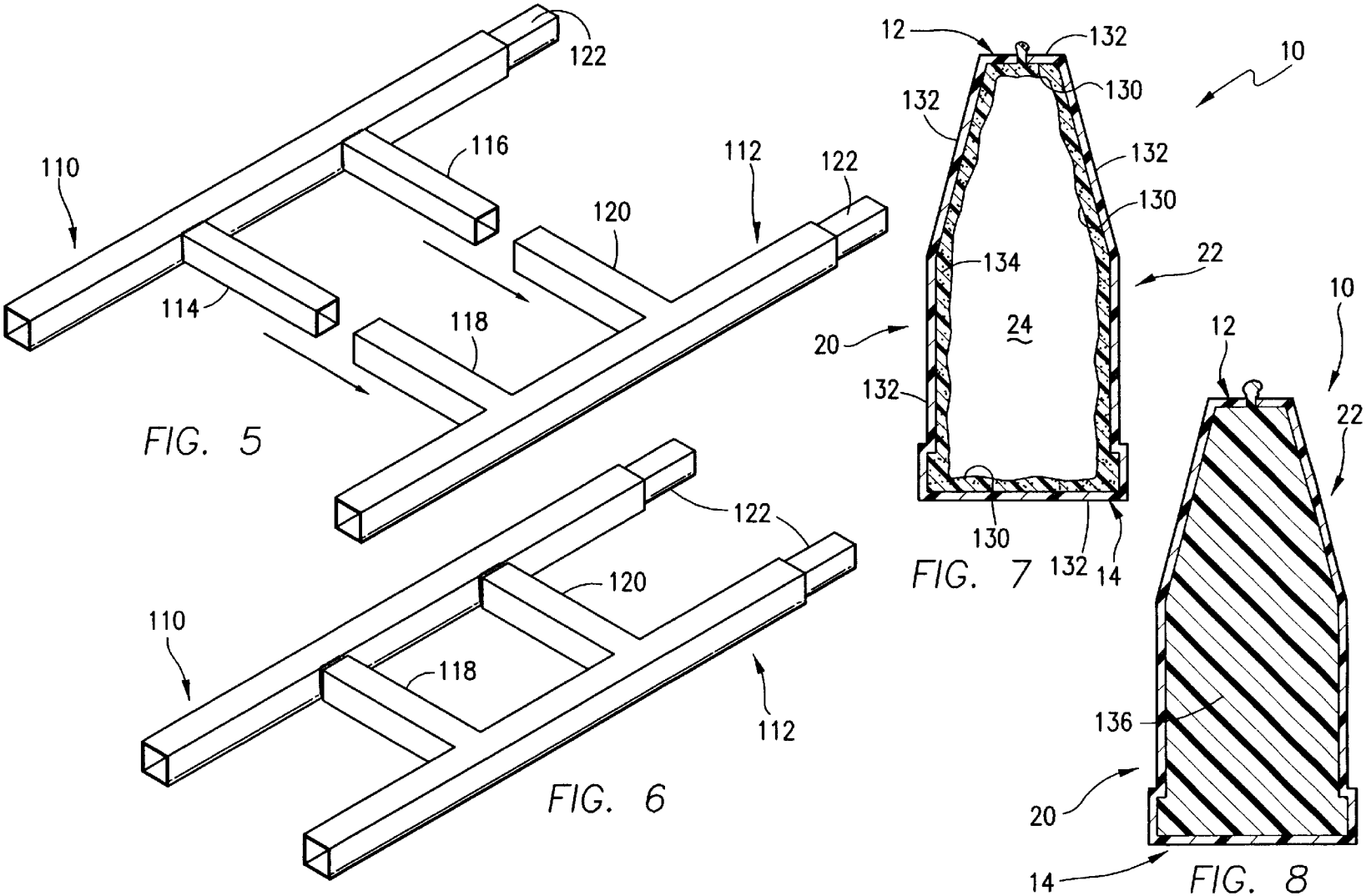
FIG. 5 is an exploded, perspective view of the mounting bracket employed with the barriers claim 4.
FIG. 6 is a perspective view of the assembled reinforcing structure of FIG. 5.
FIG. 7 is a cross sectional view of the barrier shown in FIG. 1 depicting the foam layer along the walls within the barrier interior.
FIG. 8 is a view similar to FIG. 7 except with the hollow interior of the barrier device completely filled with foam.

Referring now to FIGS. 4–6, an alternative embodiment of the external reinforcement structure of this invention is shown. Box beams 110 and 112 are provided, which, like the beams 90 and 92 noted above, are preferably square in cross section and formed of metal, rubber, composite material or the like. The box beam 110 has a pair of spaced arms 114 and 116 which extend perpendicularly therefrom, and box beam 112 is formed with a pair of perpendicularly extending sleeves 118 and 120. When the beams 110 and 112 are in position along the side wall 20 and 22, respectively, the arms 114, 116 of beam 110 register and telescope within the sleeves 118, 120 to hold them together. See FIG. 6.

Instead of a connector bar 106 used in the embodiment of FIGS. 4–8, the beams 90, 92 of one barrier 10 are connected to respective beams 90', 92' of an adjacent barrier 10' with reduced area extensions 122 formed at one end of each beam 90, 92. As best seen in FIG. 4, the extensions 122 at the end of beams 90, 92 of barrier 10 are inserted within the respective aligning ends of the beams 90', 92' of barrier 10' to connect them together. Such connection can be a friction fit between the extensions 122 and beams 90', 92' or bolts (not shown) can be employed.

Figures 14, 14A, 15C:
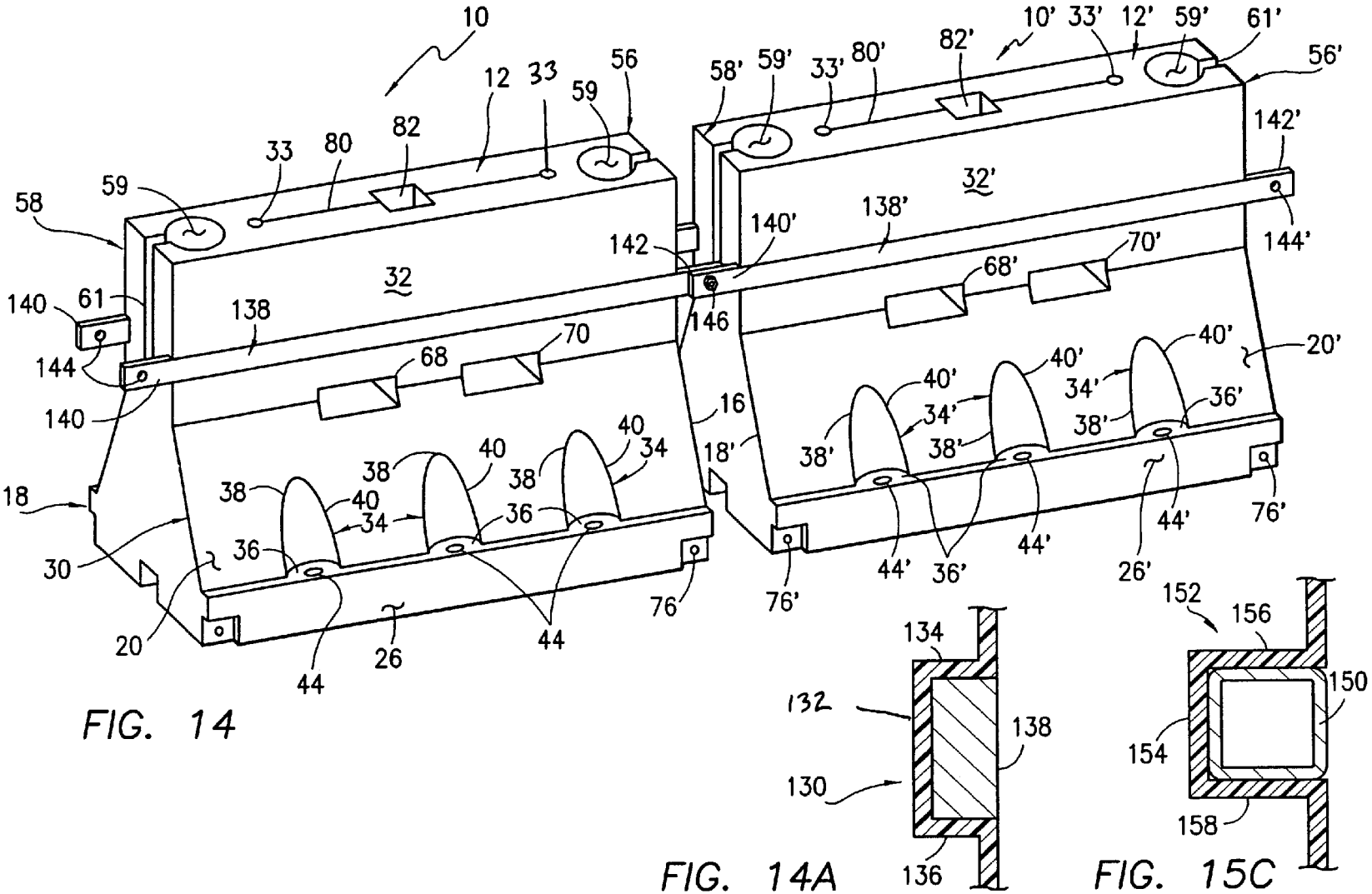
FIG. 14 is a view similar to FIG. 4, except illustrating a still further embodiment of the barrier of this invention.
FIG. 14A is a cross sectional view of a portion of a side wall and slat shown in FIG. 14.
FIG. 15C is a cross sectional view of a portion of side wall and box beam shown in FIG. 15.
Figures 15, 15A, 15B:
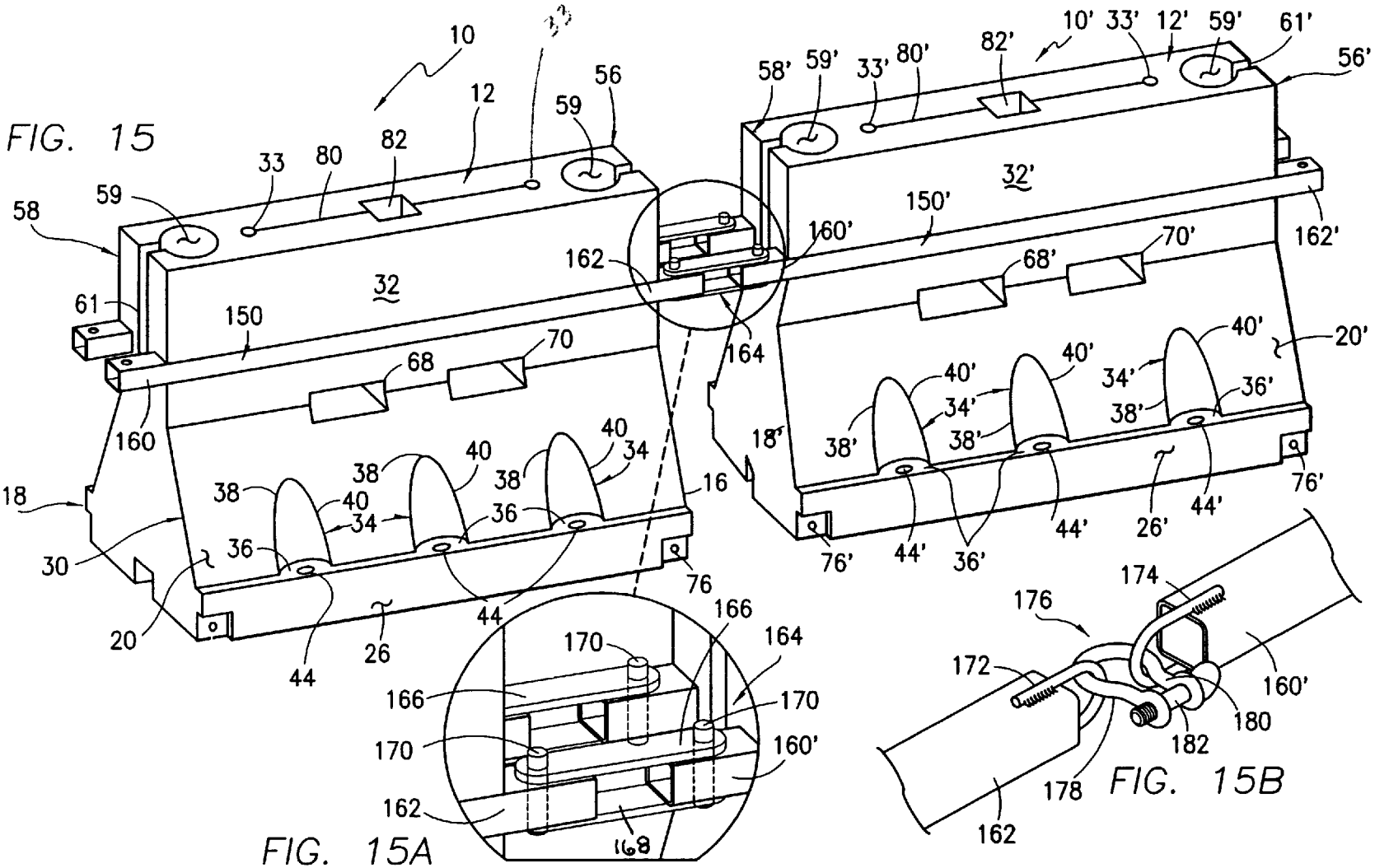
FIG. 15 is a view similar to FIG. 14, except depicting another barrier according to this invention.
FIG. 15A is an enlarged view of the encircled portion of FIG. 15.
FIG. 15B is an alternative embodiment of the encircled portion of FIG. 15 showing another connector structure for securing adjacent barriers to one another.

Still further embodiments of the external reinforcement structure according to this invention are shown in FIGS. 14 to 15C. These embodiments differ from those described above because instead of securing beams to mounting devices carried by channels 68 and 70, the barriers 10, 10' are modified to incorporate seats in each side wall which mount a beam or slat. The protruding ends of such beams or slats from one barrier are connected to those of an adjacent barrier to form a barrier wall.

Referring initially to FIGS. 14 and 14A, each side wall 20 and 22 of the barrier 10 is formed with a seat 130 which extends longitudinally between the opposed end walls 16 and 18. Each seat 130 extends from the outer surface of a respective side wall 20, 22 toward the hollow interior 24 of the barrier device 10, forming an inner wall 132, a top wall 134 and a bottom wall 136. See FIG. 14A. These walls 132, 134 and 136 of the seat 130 receive and tightly frictionally engage a generally rectangular-shaped slat 138, which is formed of metal or other rigid material and has a solid cross section. Preferably, the depth of the seat 130 is approximately equal to the thickness of the slat 138 so that the slat 138 is substantially flush with the outer surface of the side walls 20, 22 when mounted in place.

As seen in FIG. 14, opposite ends 140 and 142 of each slat 138, and opposite end 140', 142' of slat 138', protrude beyond the end walls 16, 18 of the barrier devices 10, 10' respectively, and are formed with a through bore 144. In order to connect adjacent barrier devices 10 and 10' together, the through bore 144 in the protruding end 142 of slat 138 of barrier device 10 is aligned with the through bore 144 in the protruding end 140' of the slat 138' in the barrier device 10'. A bolt 146 is then inserted through the aligning through bores 244 and secured by a nut. Alternatively, a rod (not shown) can be inserted through the aligning through bores 144 and secured with a cotter pin.

Referring now to FIGS. 15–15C, essentially the same concept described above in connection with FIGS. 14–14B is employed except using box beams 150 instead of slats 138. The side walls 20 and 22 of barrier 10 are each formed with a seat 152 having a cross section defined by an inner wall 154, spaced from the outer surface of the side walls 20, 22, a top wall 156 and a bottom wall 158. Each seat 152 frictionally engages a box beam 150, which are essentially the same construction as the box beams 92 and 112 described above. Preferably, the depth of the seat 152 and the width of the box beam 150 are approximately equal so that the box beam 150 is flush with the outer surface of each side wall 20, 22.

Two different structures for connecting the box beams 150 and 150' of adjacent barriers 10 and 10' are depicted in FIGS. 15A and 15B, although it is contemplated that other connectors could be employed. As seen in FIG. 15, opposite ends 160 and 162 of each box beam 150 protrude beyond respective end walls 16 and 18 of the barrier device 10, and the ends 160', 162' of box beam 150' protrude beyond the end walls 16', 18' of barrier device 10'. In the embodiment of FIG. 15A, the protruding end 162 of box beam 150 mounted to the barrier 10 is connected to the protruding end 160' of the box beam 150' of the barrier 10' by a bracket 164. The bracket 164 comprises a top plate 166 which spans between and rests atop the protruding ends 162 and 160' of the box beams 150, 150', and a bottom plate 168 extending along the bottom surface of the protruding ends 162, 160'. A pin, bolt of other connector 170 is inserted through one end of both plates 166, 168 and the box beam 150 of barrier 10, as well as the opposite end of both plates 166, 168 and the box beam 150' of the barrier 10'. Preferably, a pin is employed for the connectors 170 to permit at least limited pivotal motion of the barriers 10 and 10' relative to one another, i.e., each of the plates 166 and 168 can rotate about the pin connector 170, thus allowing the barriers 10, 10' to pivot.

An alternative embodiment of the connecting device between the beams 150 and 150' of adjacent barriers 10, 10' is shown in FIG. 15B. This connecting device, or "hitch connector," includes a first U-shaped member 172 mounted to the protruding end 162 of barrier 10, a second U-shaped member 174 mounted to the protruding end 160' of barrier 10' and a coupler 176 extending between the members 172, 174. Preferably, the members 172, 174 are welded or other permanently mounted to the beams 150, 150'. The coupler 176 is formed in the general shape of a C-clamp with arms 178 and 180 which engage respective members 172, 174. The free ends of arms 178, 180 and are joined by a bolt 182 to secure the coupler 176 in place. Each of the beams 150, 150' are permitted to pivot at their connection to the coupler 176, which, in turn, allows the barriers 10 and 10' pivot relative to one another.

It is believed that the combination of: (1) the extension 52-recess 48 connection; (2) the coupler 62 and locking channel 60 engagement; (3) the stake(s) 46 or other anchoring device secured within the throughbores 44 noted above, and (4) the external reinforcing structure described in connection with a discussion of FIGS. 4–6 and 9–15D collectively provides improved resistance to disengagement between adjacent barriers 10 compared to prior barrier designs.

Flotation of Barrier Devices

With reference to FIG. 7, in one preferred embodiment of this invention structure is provided to allow the barrier devices 10 and 10' to float by resisting leakage of water within which the device 10 is placed into the hollow interior 24 of the barrier device 10. Each of the walls 12, 14, 16, 18, 20 and 22 is formed with an inner surface 130 located within the hollow interior 24 and an exterior, outer surface 132. These inner surfaces 130 receive a foam layer 134 having a thickness in the range of about 0.5 to 6 inches. The remainder of the hollow interior 24 is open and can be filled with ballast material through fill holes 33 in the manner described above. The foam layer 134 is effective to seal the inner surface 130 of each wall and substantially prevent leakage of water into the hollow interior 24. Additionally, the foam layer 134 is puncture resistant, particularly as its thickness is increased, and therefore resists leakage even if the plastic walls of the barrier are damaged by fork lifts or other equipment during transit or assembly of the barriers 10.

The method of forming the barrier device 10 with the foam layer 94 forms no part of this invention, and is therefore not discussed in detail herein. Generally, a rotational molding process is employed in which a polyethylene resin and polyethylene foaming pellets are combined in a mold to form the completed barrier. Each of the walls 12, 14, 16, 18, 20 and 22 is therefore formed of a high density polyethylene using this molding technique, preferably having a thickness on the order of about 0.25 inches. One type of polyethylene resin suitable for forming the plastic walls of the barrier 10 are commercially available from Exxon-Mobil Chemical under the trademark "PAXON," Type Numbers 7004 and 7204 rotational molding resins.

One foam material which can be employed in the rotational molding process noted above to form the foam layer 134 is commercially available from Equistar Chemicals, Inc. of Houston, Tex. under the trademark "PETROTHENE." A structural foam, semi-rigid foam or flexible PETROTHENE foam may be employed in the barrier 10 and 10' of this invention, whose properties and type numbers are as follows:

| Property | Nominal Value | Units |
|---|---|---|
| MSTR005-Structural Foam | | |
| Density | 7 | $lb/ft^3$ |
| Compressive Modulus | 800 | psi |
| Shrinkage (w/MSTR003, 4 skin) | 0.010–0.015 | in/in |
| Thermal Conductivity (k) | 0.435 | BTU in/hr $ft^2$ ° F. |
| MSTR008-Semi-Rigid Foam | | |
| Density | 4 | $lb/ft^3$ |
| Compressive Modulus | 180 | psi |
| Shrinkage (w/MSTR003, 4 skin) | 0.010–0.015 | in/in |
| Thermal Conductivity (k) | 0.384 | BTU in/hr $ft^2$ ° F. |
| MSTR007-Flexible Foam | | |
| Density | 2 | $lb/ft^3$ |
| Compressive Modulus | 35 | psi |
| Shrinkage (w/MSTR003, 4 skin) | 0.010–0.015 | in/in |
| Thermal Conductivity (k) | 0.357 | BTU in/hr $ft^2$ ° F. |

In most instances it is contemplated that a semi-rigid foam would be employed to form the foam layer 134, such as PETROTHENE Type No. MSTR008, depending on the particular application for which the barrier device is intended. If additional structural rigidity is required, a denser foam with increased compressive modulus may be used such as PETROTHENE Type No. MSTR005. Further, the overall thickness of the foam layer 134 can be controlled in the molding process to increase or decrease the rigidity of the barrier 10, i.e., the thicker the foam layer 94 the more rigid the walls 12–22.

Referring now to FIG. 8, a further embodiment of this invention is shown in which the hollow interior 24 of the barrier 10 is completely filled with a foam material to form a solid foam body 136. One presently preferred foaming material is a two-component polyether-based, low density pour-in-place urethane foam commercially available from North Carolina Foam Industries of Mount Airy, N.C. under the name "NCFI Low Density Pour System 31-120." The resin properties and reaction properties of this material are as follows:

| TYPICAL RESIN PROPERTIES: | | |
|---|---|---|
| | 31-120R | 31-120A |
| Viscosity @ 72° F. | 500 cps | 200 cps |
| Weight Per Gallon | 9.5 lbs. | 10.2 lbs. |
| Appearance | amber liquid | brown liquid |
| Shelf Life | 6 months | 6 months |
| MIX RATIO: | | |
| | 31-120R | 31-120A |
| Ratio By Weight | 100 parts | 107 parts |
| Ratio By Volume | 100 parts | 100 parts |
| TYPICAL REACTION PROPERTIES: | | |
| | Hand Mix @ 72° F. | |
| Cream Time, seconds | 32 | |
| Gel Time, seconds | 140 | |
| Rise Time, seconds | 210 | |
| Density (FRC) | 1.9 pcf | |

As noted above and shown in FIGS. 4 and 9, adjacent barriers 10 can be connected end-to-end to form a barrier wall. With the barriers filled with foaming material to form a solid foam body 136 within the hollow interior 24, the individual barriers 10 and collectively formed barrier wall readily floats in water. Although the embodiment of the barrier 10 shown in FIG. 7 will also float, it is contemplated that that the provision of a foam body 136 within the barrier interior 24 will result in a more durable structure with better integrity in the event of impact with a vessel or other object. A barrier wall formed with individual barrier devices 10 and 10' of the type shown in FIG. 13 can be utilized in a variety of marine applications to encircle vessels and other objects in the water, as well as to prevent access to given areas within a port or docking area as desired. Further resistance to impact is provided with the addition of the external reinforcement structure shown in FIGS. 4–6 or 9–13, in combination with the barrier devices 10 including foam material depicted in FIGS. 7 and 8.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof.

For example, while the barrier 10 of FIG. 8 is illustrated with a foam body 136 which substantially entirely occupies the volume of the hollow interior 24, a foam body of lesser volume could be employed. Additionally, the "external reinforcing structure" of this invention is characterized as a "beam" and depicted in the Figs. as either a hollow member having a generally square cross section (FIGS. 4–6, 9–13 and 15–15C) or a solid, substantially rectangular-shaped slat (FIGS. 14 and 14A). It should be understood that the term "beam" as used herein is not limited to the particular structures shown, but is meant to broadly include hollow and solid members of essentially any cross sectional shape as well as members whose outer surface includes openings such as a cage structure or the like.

Therefore, it is intended that the invention not be limited to the particular embodiment disclosed as the best mode contemplated for carrying out this invention, but that the invention will include all embodiments falling within the scope of the appended claims.

We claim:

1. A barrier device, comprising:

a top wall, a bottom wall, opposed end walls and opposed side walls interconnected to collectively form a hollow interior;

at least one opening extending through said hollow interior from one of said side walls to the other of said side walls;

a barrier reinforcement structure including a first beam extending along one of said side walls, a second beam extending along said other side wall and a mounting device which extends through said at least one opening in said hollow interior and connects to each of said first and second beams.

2. The barrier device of claim 1 in which said at least one opening comprises a first opening and a second opening spaced from said first opening, said first and second openings being adapted to receive the tines of a fork lift.

3. The barrier device of claim 1 in which each of said first and second beams is a box beam having a generally square cross section.

4. The barrier device of claim 1 in which said mounting device is a bracket inserted within said at least one opening, said bracket having a first end protruding from one side wall and a second end protruding from the other side wall, said first beam being connected to said protruding first end of said bracket and said second beam being connected to said protruding second end of said bracket.

5. The barrier device of claim 4 in which said at least one opening forms a channel within said hollow interior, said bracket comprising a plate having opposed sides and said first and second ends, and a pair of arms each mounted to one of said sides of said plate, said arms resting atop a wall formed by said channel in said hollow interior and providing a space between said plate and said wall to permit the insertion of the tines of a fork lift while said bracket remains in place within said channel.

6. The barrier device of claim 1 in which said mounting device comprises cooperating telescoping members extending from each of said first and second beams through said at least one opening in said hollow interior.

7. The barrier device of claim 6 in which a sleeve is connected generally perpendicularly to said first beam, and an arm is connected generally perpendicularly to said second beam, said sleeve and said arm extending into said at least one opening in said hollow interior with said arm telescoping into said sleeve to connect said first and second beams together.

8. The barrier device of claim 1 in which each of said top wall, bottom wall, opposed side walls and opposed end walls has an inner surface within said hollow interior, each of said inner surfaces mounting a layer of foam material.

9. The barrier device of claim 8 in which said layer of foam material has a thickness in the range of about 0.5 to 6 inches.

10. The barrier device of claim 1 in which said hollow interior is substantially filled with a foam material.

11. A barrier device, comprising:

a top wall, a bottom wall, opposed end walls and opposed side walls interconnected to collectively form a hollow interior;

a first opening and a spaced, second opening each extending through said hollow interior from one of said side walls to the other of said side walls;

a first bracket carried within said first opening and a second bracket carried within said second opening, each of said first and second brackets having a first end protruding from one side wall and an opposite, second end protruding from the other side wall;

a first beam extending along said one side wall and mounted to said protruding first ends of said first and second brackets, and a second beam extending along said other side wall and mounted to said protruding second ends of said first and second brackets.

12. The barrier device of claim 11 in which each of said first and second beams is a box beam having a generally square cross section.

13. The barrier device of claim 11 in which said first and second openings each form a channel within said hollow interior, said bracket comprising a plate having opposed sides and said first and second ends, and a pair of arms each mounted to one of said sides of said plate, said arms resting atop a wall formed by said channel in said hollow interior and providing a space between said plate and said wall to permit the insertion of the tines of a fork lift while said bracket remains in place within said channel.

14. The barrier device of claim 11 in which each of said top wall, bottom wall, opposed side walls and opposed end walls has an inner surface within said hollow interior, each of said inner surfaces mounting a layer of foam material.

15. The barrier device of claim 14 in which said layer of foam material has a thickness in the range of about 0.5 to 6 inches.

16. The barrier device of claim 11 in which said hollow interior is substantially filled with a foam material.

17. A barrier device, comprising:

a top wall, a bottom wall, opposed end walls and opposed side walls interconnected to collectively form a hollow interior;

a first opening and a spaced, second opening each extending through said hollow interior from one of said side walls to said other side wall;

a first beam located along one of said side walls, a pair of spaced sleeves extending generally perpendicularly to said first beam, a second beam located along the other of said side walls, a pair of spaced arms extending generally perpendicularly to said second beam, said arms being dimensioned to be inserted within said sleeves;

said sleeves of said first beam each extending through one of said first and second openings in position to telescopically receive one of said arms of said second beam so that said first and second beams are connected together along said opposed side walls.

18. The barrier device of claim 17 in which each of said top wall, bottom wall, opposed side walls and opposed end walls has an inner surface within said hollow interior, each of said inner surfaces mounting a layer of foam material.

19. The barrier device of claim 18 in which said layer of foam material has a thickness in the range of about 0.5 to 6 inches.

20. The barrier device of claim 17 in which said hollow interior is substantially filled with a foam material.

21. A barrier wall, comprising:

a number of individual barrier devices connected end-to-end, each of said barrier devices including:

(i) a top wall, a bottom wall, opposed end walls and opposed side walls interconnected to collectively form a hollow interior;

(ii) at least one opening extending through said hollow interior from one of said side walls to the other of said side walls;

(iii) a barrier reinforcement structure including a first beam extending along one of said side walls, a second beam extending along said other side wall and a mounting device which extends through said opening in said hollow interior and connects to each of said first and second beams;

connecting structure located at each end of said first beam and said second beam of each barrier device, said connecting structure being effective to connect said first beam of one barrier device to said first beam of an adjacent barrier device and said second beam of said one barrier device to said second beam of said adjacent barrier device.

22. The barrier wall of claim 21 in which said mounting devices of each of said barrier devices is a bracket inserted within said at least one opening, said bracket having a first end protruding from one side wall and a second end protruding from the other side wall, said first beam being connected to said protruding one end of said bracket and said second beam being connected to said protruding other end of said bracket.

23. The barrier wall of claim 22 in which said at least one opening forms a channel within said hollow interior bracket comprising a plate having opposed sides and said first and second ends, and a pair of arms each mounted to one of said sides of said plate, said arms resting atop a wall formed by said channel in said hollow interior, and providing a space between said plate and said wall to permit the insertion of the tines of a fork lift while said bracket remains in place within said channel.

24. The barrier device of claim 21 in which said mounting devices of each of said barrier devices comprise cooperating telescoping members extending from each of said first and second beams through said at least one opening in said hollow interior.

25. The barrier wall of claim 24 in which a sleeve is connected generally perpendicularly to said first beam, and an arm is connected generally perpendicularly to said second beam, said sleeve and said arm extending into said at least one opening in said hollow interior with said arm telescoping into said sleeve to connect said first and second beams.

26. The barrier wall of claim 21 in which said connecting structure comprises a connector bar inserted within and connected to one end of each of said first and second beams of each barrier device, said connector bar protruding from said one end of said first and second beams of one barrier device and being inserted into and mounted within an end of the first and second beams of an adjacent barrier device to interconnect said barrier devices.

27. The barrier wall of claim 21 in which said first and second beams of each of said barrier devices have opposed ends, said connecting structure including an extension formed at one end of each of said first and second beams of each barrier device, said extensions having a smaller cross-sectional area than the other end of said first and second beams, said extensions of said first and second beams of one barrier device being inserted within and connected to said other ends of the first and second beams of an adjacent barrier device to connect the two barrier devices together.

28. The barrier wall of claim 21 in which said top wall, bottom wall, opposed end walls and opposed side walls of each barrier device has an inner surface within said hollow interior, each of said inner surfaces mounting a layer of foam material.

29. The barrier wall of claim 28, in which said layer of foam material has a thickness in the range of about 0.5 to 6 inches.

30. The barrier wall of claim 21 in which said hollow interior of each barrier device is substantially filled with a foam material.

* * * * *